US005560231A

United States Patent [19]

Hwang

[11] Patent Number: 5,560,231

[45] Date of Patent: Oct. 1, 1996

[54] WATER SUPPLY APPARATUS FOR A CLOTHES WASHING MACHINE

[75] Inventor: Jeong J. Hwang, Suwon, Rep. of Korea

[73] Assignee: Samsung Electronics Co., Ltd., Suwon, Rep. of Korea

[21] Appl. No.: 394,265

[22] Filed: Feb. 22, 1995

[30] Foreign Application Priority Data

Mar. 22, 1994 [KR] Rep. of Korea ..... 94-5803

[51] Int. Cl.[6] ..... D06F 39/08

[52] U.S. Cl. ..... 68/207; 137/343

[58] Field of Search ..... 68/207; 134/98.1, 134/100.1; 137/343, 356, 606

[56] References Cited

U.S. PATENT DOCUMENTS 3,381,700 5/1968 Frymark ..... 68/207 X 5,425,255 6/1995 Pick ..... 68/207

FOREIGN PATENT DOCUMENTS 63094 4/1985 Japan ..... 68/207

87591 5/1986 Japan ..... 68/207

*Primary Examiner*—Philip R. Coe

*Attorney, Agent, or Firm*—Burns, Doane, Swecker & Mathis, L.L.P.

[57] ABSTRACT

A water supply apparatus for a clothes washing machine includes a pair of valve bodies each having a water inlet and a water outlet pipe. The water outlet pipes are secured between mating edges of a pair of wall portions of a housing of the washing machine. The water outlet pipes are disposed either entirely within notches formed in one of the wall portions, or partially within notches formed in both of the wall portions. The valved members include outward protrusions slidably disposed in at least one of the wall portions.

11 Claims, 5 Drawing Sheets

WATER SUPPLY APPARATUS FOR A CLOTHES WASHING MACHINE

BACKGROUND OF THE INVENTION

The present invention is related to a water supply apparatus for a clothes washing machine, and moire particularly to a mounting for such a water supply apparatus.

A prior art clothes washing machine, shown in FIG. 1, comprises a housing 1 with a top opening 18 closed or opened by a lid cover 16, a water container 2 and a wash tub 3 therein, for washing and dehydrating laundry.

The wash tub 3 is disposed in the water container 2 to form a space therebetween for containing wash water, and a pulsator 4 is rotatably mounted on the bottom of the wash tub 3. Further, a motor 5 and a power transmission member 6 for providing a driving force for rotating the wash tub 3 and the pulsator 4, and a clutch 7 for engaging or disengaging the driving motor with the power transmission member 6 are mounted under the wash tub 2, whereby a rotating force is selectively transmitted to the wash tub 3 and the pulsator 4.

A water supply apparatus 20 is mounted at the upper portion of the housing 1. The water supply apparatus 20 is placed between a frame 13 disposed onto the upper portion of the housing 1 and a cover 14. The water supply apparatus 20 is connected with a cool water faucet 28 and warm water faucet tab 29. The warm or cool water is fed into the water container 2 corresponding to respective washing processes.

In FIG. 2, the prior art water supply apparatus 20 comprises a cool water valve member 25 and a warm water valve member 26. Each of the valve members 25, 26 is comprised of a body 25B, 26B containing a valve which is not shown, inflowing pipes 25A, 26A receiving the water inflowed from the cool 28 or warm water faucet 29, and outflowing pipes 25C, 26C discharging the cool or warm water depending on the selective closing or opening of the valve. Furthermore, a pair of brackets 27, 27 project from the periphery of respective inflowing pipe 25A,26A adjacent to the body 25B,26B.

Openings 27A are formed at the upper and lower each bracket 27 and are aligned with openings 13C formed in the frame 13. Furthermore, in the frame 13 are formed a first through opening 13A and a second thru-opening 13B through which the inflowing pipes 25A,26A are penetrated. The opening 27A of the bracket 27 and the opening 13C of the bracket 13 are interconnected by a screw 23, whereby the valve members 25,26 are demountably secured to the frame 13.

The water supply apparatus structured as above has a problem in that a larger number of manufacturing processes are required. That is, respective openings are provided at the bracket and the frame, and the process in which the openings are assembled by the screw is further employed. Meanwhile, when the openings formed in bracket and the frame are misaligned, the screws cannot be inserted therethrough.

Furthermore, additional screws for assembling the bracket and the frame are needed, thereby causing another problem in that the quantity of components is increased.

SUMMARY OF THE INVENTION

In order to resolve these problems, a main object of the present invention is to provide a water supply apparatus for a clothes washing machine.

Another object of the present invention is to provide a water supply apparatus for a clothes washing machine in which the assembling time is reduced due to a simplying of the joining process and poor assembling quality can be eliminated.

Another object of the present invention is to provide a water supply apparatus for a clothes washing machine in which the convenient assembling can be achieved without separate fasteners (e.g., screws) so that the quantity of the components can be reduced.

In order to accomplish these objectives, the present invention relates to a water supply apparatus for a clothes washing machine comprised of a pulsator having a wash tub therein; a water container having the wash tub; a driving means operating selectively the pulsator and the wash tub; a housing including the wash tub and the driving means; a frame placed on the upper portion of the housing and including a water supply apparatus; and a cover shielding the upper portion of the frame for protecting the water supply apparatus; the water supply apparatus detachably fitting the frame.

Further, a plurality of protrusions formed around the periphery of the water supply apparatus slidingly fit respective grooves formed respectively at the frame and the cover.

Alternatively, a plurality of protrusions formed around the periphery of the water supply apparatus slidingly fit respective grooves formed at the frame.

DETAILED DESCRIPTION OF THE PREFERRED EMBODIMENTS

Figure 1:
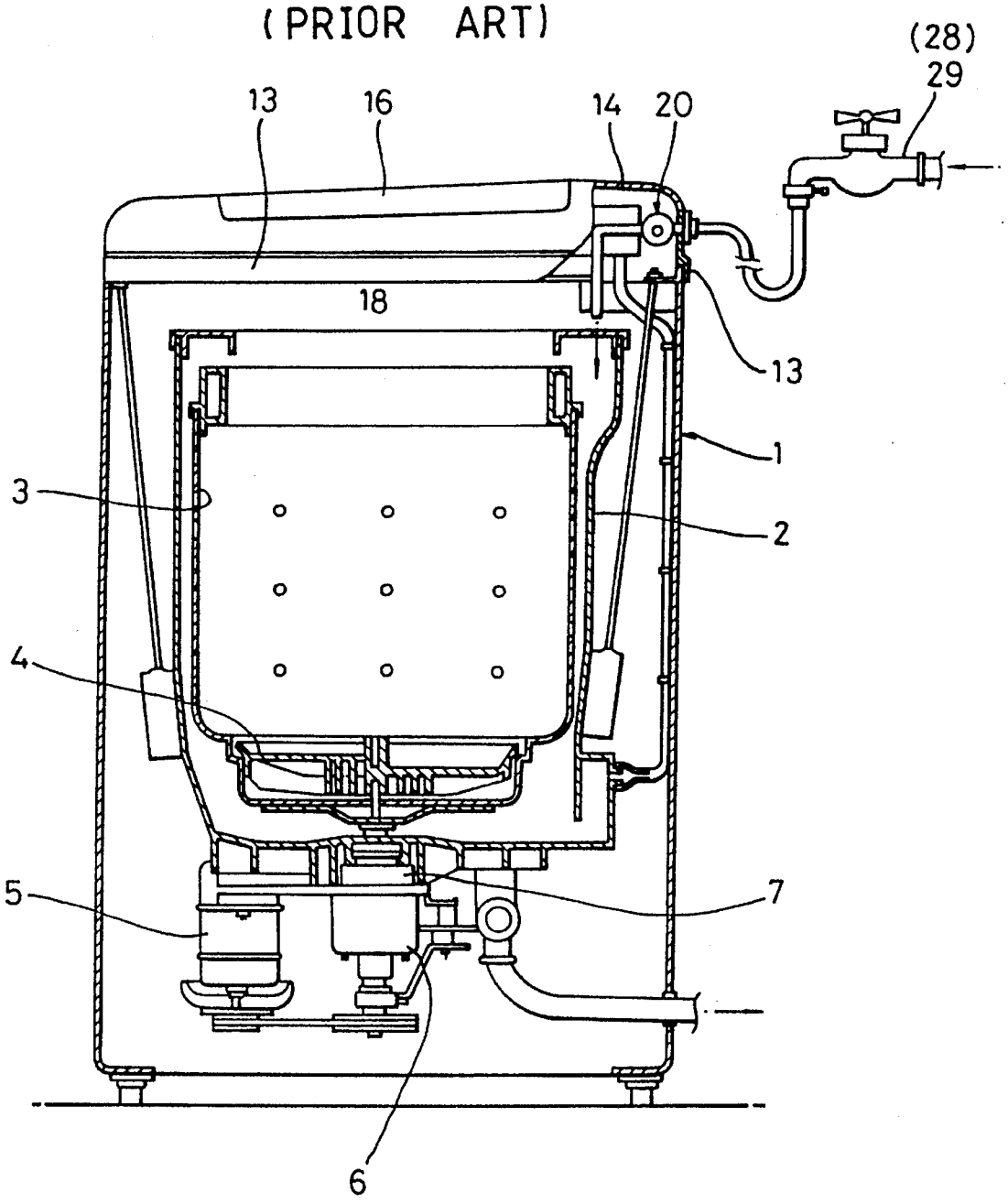
FIG. 1 (PRIOR ART)
FIG. 1 is a vertical cross-sectional view showing a clothes washing machine having a prior art water supply apparatus.
Figure 2:
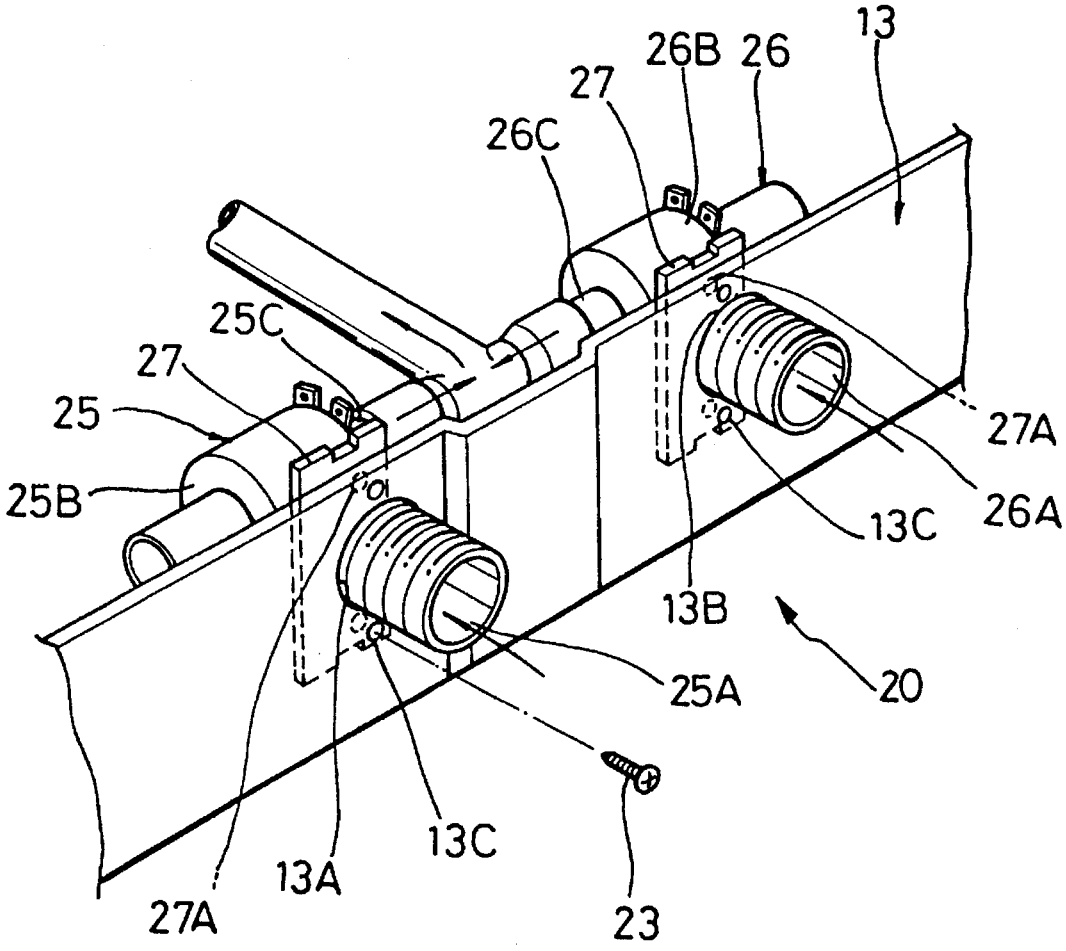
FIG. 2 (PRIOR ART)
FIG. 2 is a perspective view of the prior art water supply apparatus of FIG. 1.
Figure 3:
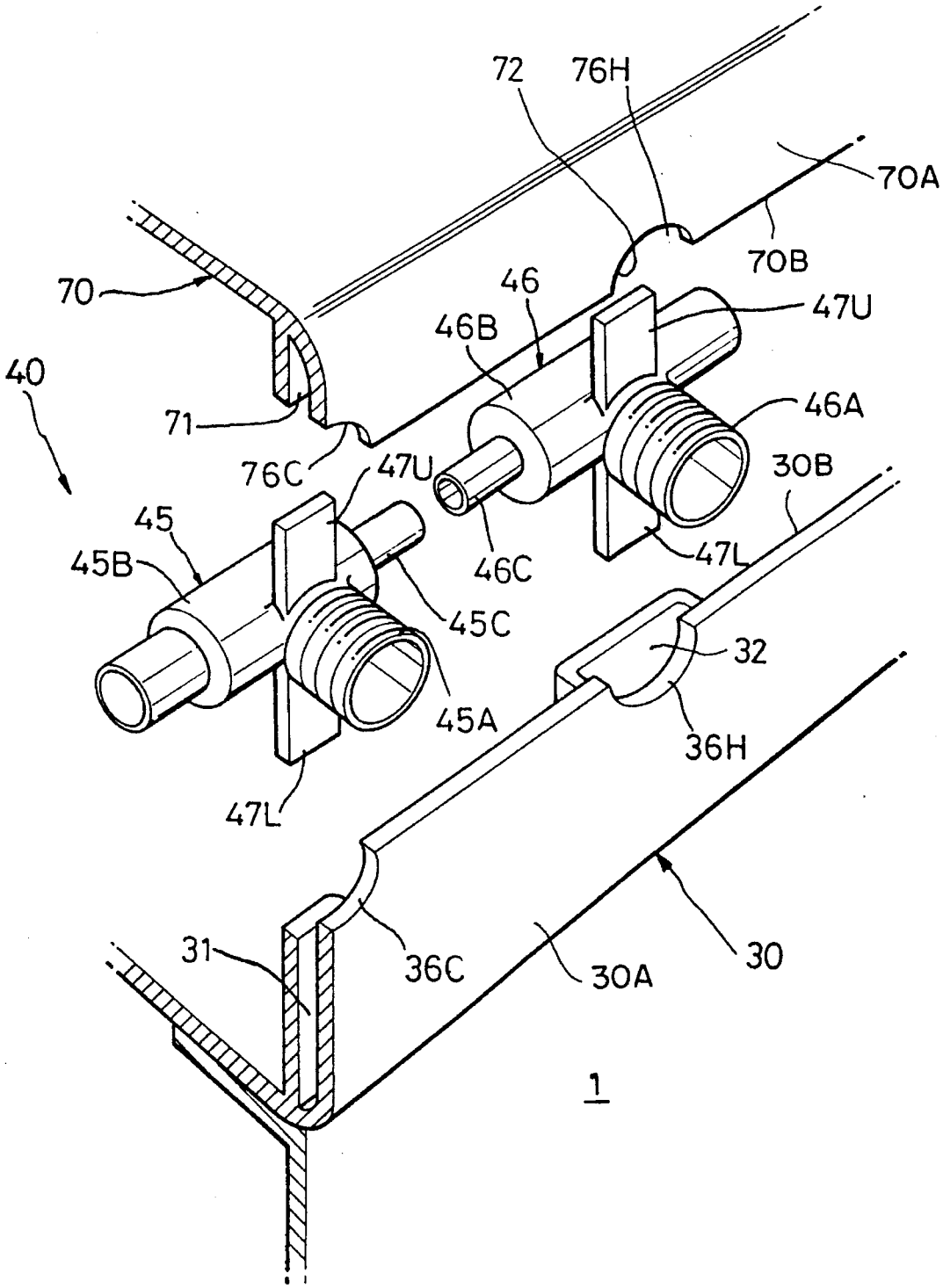
FIG. 3 is an exploded perspective view of one embodiment of the water supply apparatus according to the present invention.
Figure 4:
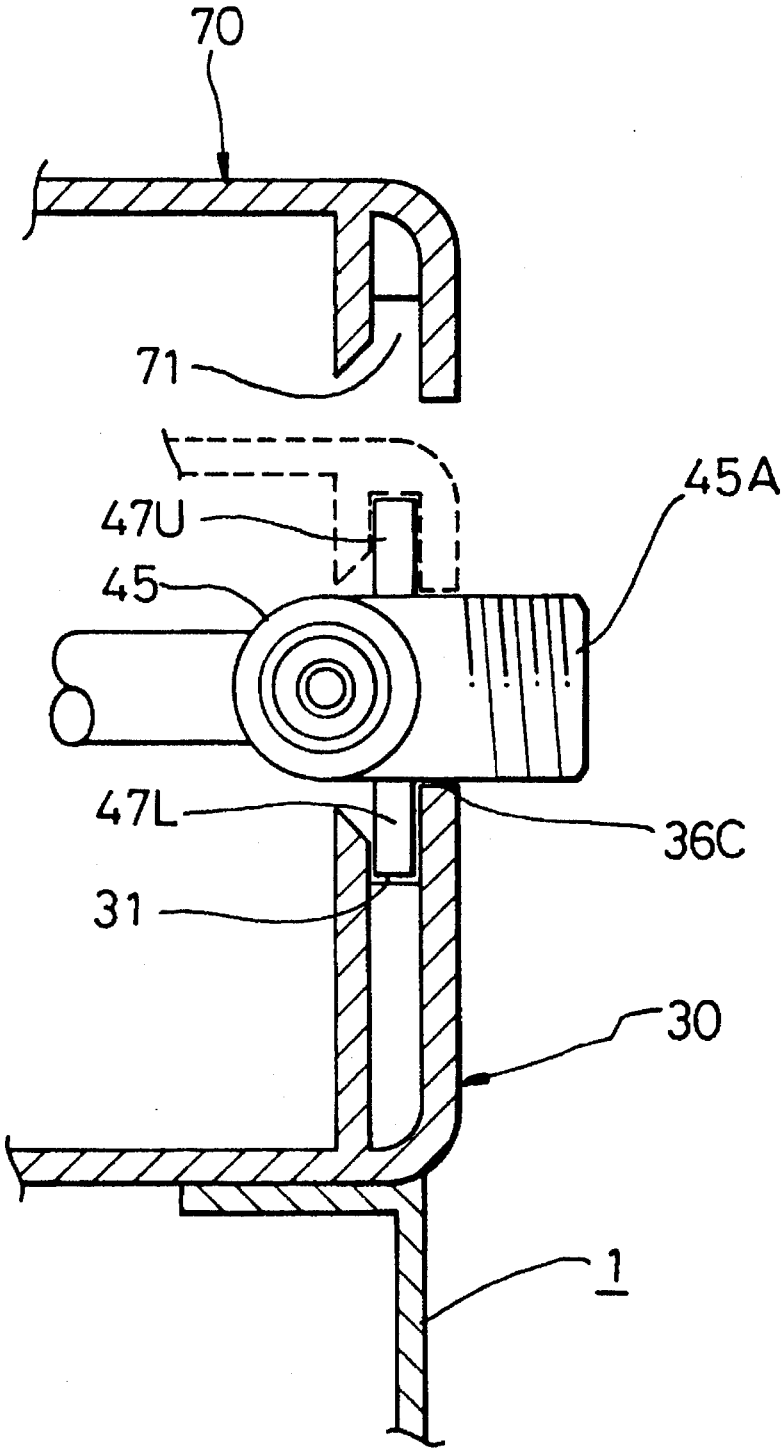
FIG. 4 is a side cross-sectional view of FIG. 3.

FIGS. 3 and 4 illustrate one embodiment of a water supply apparatus for a washing machine according to the present invention.

The water supply apparatus 40 comprises a cool water valve member 45 and a warm water valve member 46. Each of the valve members 45,46 is comprised of a body 45B,46B containing a valve which is not shown, inflowing pipes 45A,46A receiving the water inflowed from water faucets, and outflowing pipes 45C,46C discharging the cool or warm water depending on the selective closing or opening of the valve. Furthermore, a pair of brackets 47U,47L extend upward and downward from the periphery of each inflowing pipes 45A, 46A adjacent to the body 45B, 46B.

In a vertical side wall portion 30A of a frame 30 of the outer housing are formed a first groove 31 and a second groove 32 for slidingly receiving respective lower brackets 47L. Further, in the wall 30A are formed a first notch 36C and a second notch 36H for receiving lower halves of respective inflowing pipes 45A,46B.

In a vertical peripheral wall 70A of a cover 70 are formed a third groove 71 and a fourth groove 72 for slidingly receiving respective upper brackets 47U. Further, in the cover 70 are formed a third notch 76C and a fourth notch 76H for receiving upper halves of respective inflowing pipes 45A,46B.

In the water supply apparatus 40 structured as above, the lower bracket 47L of the cool water valve member 45 is slidingly fitted into the first groove 31 of the frame 30 as shown in FIG. 4. When the lower portion of the inflowing pipe 45A is rested on the first notch 36C, the third groove 71 of the cover 70 encompasses the upper bracket 47U of the cool water valve member 45, whereby the assembly process of the cool supply apparatus is completed. The assembly process is similarly applied to the warm water valve member. Thus, the water outlet pipes 45A, 46A are clamped between mating edges 30B, 70B of the wall portions 30A, 70A.

Figure 5:
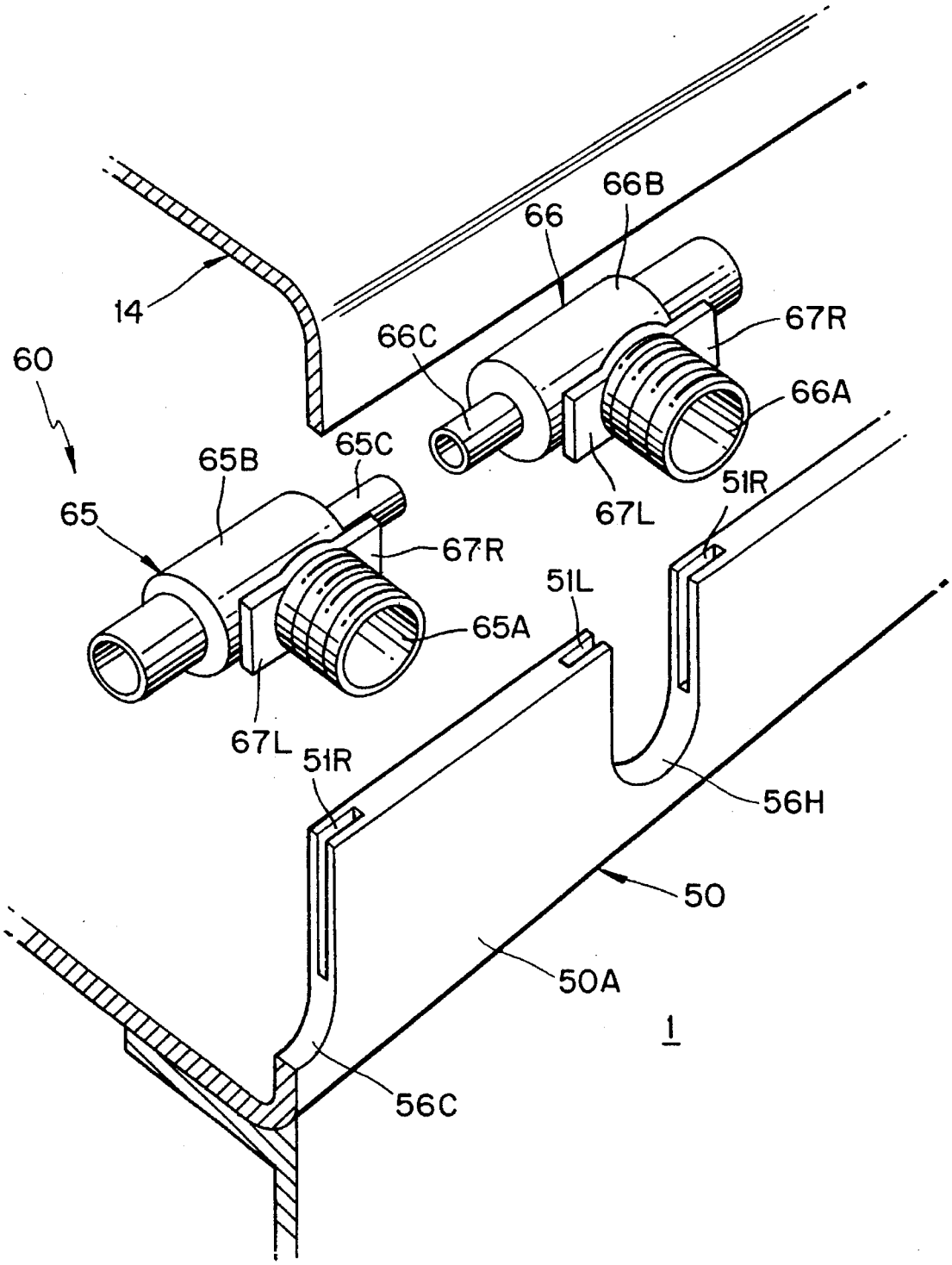
FIG. 5 is an exploded perspective view of another embodiment of a water supply apparatus according to the present invention.

Alternatively, FIG. 5 illustrates a second embodiment of the water supply apparatus.

The water supply apparatus 60 comprises, as in the first embodiment, a cool water valve member 65 and a warm water valve member 66 Each of the valve members 65, 66 is comprised of a body 65B,66B containing a valve which is not shown, inflowing pipes 65A,66A receiving the water inflowed from water faucets, and outflowing pipes 65C,66C discharging the cool or warm water depending on the selective operation of the valves. Furthermore, a pair of brackets 67R,67L project rightward and leftward from the periphery of each inflowing pipe 65A,66A adjacent to the body 65B,66B.

In a vertical wall 50A, a frame 50 are formed slots 51R,51L for slidingly receiving respective right and left brackets 67R, 67L. Further, in the wall 50A are formed notches 56H,56C for receiving respective inflowing pipes 65A, 66B.

In this case, the cover 14 is formed with an ordinary configuration without the notches provided in the first embodiment. The downward edge of the cover 14 pushes the upper portion of brackets 67R,67L of the valve members 65,66 down, wherein the valve members 65,66 are held in the slots 51R,51L of the frame 50.

As explained in the embodiments, the frame has grooves or slots; and brackets corresponding to the grooves or the slots are formed in the body of the valve member. The brackets are slidingly fitted into the grooves or the slots, wherein the assembling time can be reduced and the components for joining the valve member and the frame are reduced so that the cost of manufacturing can be also reduced.

What is claimed is:

1. A clothes washing machine comprising:

a water container;

a wash tub disposed in said water container and including a pulsator;

a drive mechanism for selectively driving said wash tub and pulsator;

a housing encompassing said water container and including a wall structure; and a water supply apparatus detachably fitted into said wall structure;

said wall structure including upper and lower vertical wall portions having mating edges, first portions of said water supply apparatus being situated between said edges to prevent vertical movement of said water supply apparatus, second portions of said water supply apparatus being disposed in grooves disposed in at least one of said wall portions for preventing horizontal movement of said water supply apparatus.

2. The clothes washing machine according to claim 1, wherein said lower wall portion comprises a side portion of said outer housing, and said upper wall portion comprises a portion of a cover of said housing.

3. A clothes washing machine comprising:

a water container;

a wash tub disposed in said water container and including a pulsator;

a drive mechanism for selectively driving said wash tub and pulsator;

a housing encompassing said water container and including a wall structure; and a water supply apparatus detachably fitted into said wall structure;

said water supply apparatus including a cold water supply member and a hot water supply member, each of said cold and hot: water supply members comprising a body having a bracket structure projecting outwardly therefrom; said water supply apparatus further including a water inlet, and a water outlet, said water outlet including a pipe; said wall structure including an edge, and a pair of notches formed in said edge; each notch receiving at least a portion of a circumference of a respective one of said water outlets; said wall structure further including a pair of grooves receiving said bracket structure.

4. The clothes washing machine according to claim 3, wherein said wall structure includes upper and lower wall portions forming mating edges including said edge containing said notches, said water outlets being situated between said edges.

5. The clothes washing machine according to claim 4, wherein each of said edges has said notches, each notch receiving one half of said circumference of a water outlet pipe.

6. The clothes washing machine according to claim 5, wherein each of said wall portions contains said slots for receiving said bracket structure.

7. The clothes washing machine according to claim 3, wherein each notch receives the entire circumference of a respective water outlet pipe.

8. The clothes washing machine according to claim 7, wherein said slots open into respective ones of said notches.

9. A clothes washing machine comprising:

a water container;

a wash tub disposed in said water container and including a pulsator;

a drive mechanism for selectively driving said wash tub and pulsator;

a housing encompassing said water container and including a wall structure; and a water supply apparatus detachably fitted into said wall structure;

said water supply apparatus including a plurality of protrusions, said wall structure including grooves for slidably receiving said protrusions.

10. The clothes washing machine according to claim 9, wherein said wall structure includes a side wall of said housing and a peripheral wall of a cover of said housing, said grooves formed in at least one of said side and peripheral walls.

11. The clothes washing machine according to claim 10, wherein said grooves are formed in both of said side and peripheral wall portions.

* * * * *